United States Patent [19]

Newlon et al.

[11] 4,339,845

[45] Jul. 20, 1982

[54] SPRING HINGE

[75] Inventors: Robert L. Newlon, Sterling; Delmar McNinch, Rock Falls, both of Ill.

[73] Assignee: Lawrence Brothers, Inc., Sterling, Ill.

[21] Appl. No.: 904,276

[22] Filed: May 9, 1978

[51] Int. Cl.[3] ..... E05F 1/12

[52] U.S. Cl. ..... 16/300

[58] Field of Search ..... 16/189, 188, 180, 186, 16/183, 134, 128 R; 85/1 R, 1 SS

[56] References Cited

U.S. PATENT DOCUMENTS

| | | | |
|---|---|---|---|
| 1,140,308 | 5/1915 | Katzenberger | 16/189 |
| 2,493,115 | 1/1950 | Diebel | 16/189 |
| 2,830,635 | 4/1958 | Thorstens | 85/1 SS |
| 4,043,001 | 8/1977 | Parsons | 16/189 |
| 4,102,013 | 7/1978 | Newlon | 16/189 |

*Primary Examiner*—Peter P. Nerbun

*Attorney, Agent, or Firm*—Trexler, Bushnell & Wolters, Ltd.

[57] ABSTRACT

There is disclosed a spring hinge comprised of a pair of hinge leaves each having at least one tubular hinge knuckle, the knuckles being in axial alignment to define a bore, a torsion spring member extending axially through the knuckle bore and having its opposite ends affixed to a pair of capstan members for rotation in unison therewith. The first capstan member is non-rotatably mounted within one of the hinge knuckles, while the second capstan member is rotatably mounted within the other hinge knuckle. The second capstan member includes a plurality of circumferentially spaced sockets selectively movable into registry with a through aperture in the associated hinge knuckle, such that a retaining pin member may be inserted therein. The pin member holds the capstan in a desired radial position to impart a desired degree of torsional force or tension to the spring member. The pin member has first and second portions of different diameters thereby defining a shoulder portion. The torsion spring tends to rotate the capstan so as to hold at least a pair of the shoulder portion out of registry with the hinge aperture to substantially preclude axial removal of the pin member therethrough due to vibration or the like. The pin member also has an enlarged, severable head portion to facilitate its insertion, which head portion can be fractured and removed following the insertion.

11 Claims, 4 Drawing Figures

SPRING HINGE

BACKGROUND OF THE INVENTION

This invention relates generally to spring hinges for doors and the like, which are designed to exert a door-closing force; and more particularly to such a hinge which provides for selective adjustment of said door-closing force, wherein the hinge remains substantially unaffected by vibration or the like which may occur during use.

Many buildings and fire codes for hotels, motels, apartments and like structures require the installation of door closer devices. In many such cases it is both convenient and economical to provide spring door hinges for automatically closing the doors, rather than the more expensive and bulkier hydraulic closer units. Spring hinges are generally known in the art and are disclosed, for example in U.S. Pat. No. 3,903,567 and the art cited therein.

In the use of such prior art spring hinge devices, it has been found desirable to provide for loading of the spring at the installation site, and after door has been hung, further it is also desirable to select the amount of closing force to be exerted by such hinge structures at this time. More specifically, such prior art hinge structures have generally been provided with means for torsioning or preloading the coil or torsion springs therein, either during assembly at the factory, or during installation, to accommodate the particular application in which the hinge is to be used. Generally speaking, such hinge structures include a pair of adjacent leaves, each having at least one hinge knuckle in axial alignment with a hinge knuckle defined on the opposite leaf. A spring member is inserted through the knuckles, a first end of the spring being non-rotatably mounted to a plug or capstan member fixed for rotation in unison with one of the hinge knuckles. The opposite end of the spring is similarly non-rotatably mounted with a second plug or capstan member, which second member is free to rotate with respect to the opposite hinge knuckle. The desired degree of torsional force may be imparted to the spring member by rotating the second capstan member and then fixing it in position when such force is attained. Further, the second capstan member is generally provided with a plurality of circumferentially arranged sockets which are successively brough into registry with a through aperture in the associated knuckle as the capstan is rotated. Once the desired degree of torsional force has been attained, a suitable pin member is then inserted through the aperture and socket to maintain the capstan in a fixed position thereby maintaining the spring tension.

For numerous reasons, it is not practical to preload the spring at the factory. One reason is that different spring loadings are required for various types of doors and door mountings. A more important reason why it is desirable to tension the spring at the installation site, is that it is extremely difficult to hang a door using active spring hinges. Accordingly, the spring hinges of the prior art, like that of the present invention are designed to be torsioned after the door has been installed.

One significant problem that has arisen in the use of prior art spring hinges that are activated at the installation site is the maintaining of the pin member in position throughout the service life of the hinge. Many arrangements have been suggested including complimentarily threading of the retaining pin member and the capstan sockets; press fitting the pin member into the capstan socket; forming the pin member with the splines or knurles to bite into the capstan socket. It has been found, however, that with all of these arrangements the retaining pin member remains subject to gradual loosening, and ultimate disengagement from the capstan socket due to loading and shock forces, and the vibrational forces to which the hinge is subjected during operation. Moreover, where such press fitting or similar engagement arrangements are utilized, it is difficult, and often impossible, to reinsert the pin properly, once it has been removed, as would be employed in readjustment of the torsioning force. Accordingly, it is a general object of this invention to provide a door hinge of the type described which is relatively simple to adjust for the desired degree of torsional force, yet reliably maintains such adjustment, once made, and can easily be readjusted, should it be desired to change the amount of torsional door-moving force provided thereby.

Briefly, and in accordance with the present invention, there is provided a spring hinge comprised of a pair of adjacent hinge leaves, each leaf having at least one hinge knuckle on the opposite leaf. A spring mechanism is carried by the knuckles, having a first end non-rotatably affixed to a first capstan member or the like which is affixed to or integral with one hinge knuckle, and as such will rotate therewith. The opposite end of the spring is non-rotatably affixed to a second capstan member which is adjustably mounted in the opposite hinge knuckle. This second capstan member includes a plurality of circumferentially spaced sockets which may be successively brought into registry with a through aperture in the associated knuckle, upon rotation of the capstan to torsion the spring, and a retaining pin inserted through the hinge knuckle aperture to fix the capstan in position once the desired amount of spring force is attained. The pin member includes a first portion engaged in the socket and a second portion received in the aperture, said second portion being of a lesser diameter thereby defining a shoulder portion therebetween. Consequently, following insertion of the pin member, the spring force will tend to rotate the capstan, which is restricted by the pin, however, due to the reduced diameter of the second portion, slight movement will occur, moving the shoulder on the pin out of registry with the knuckle aperture. As such, inadvertent removal of the pin member is precluded due to the non-alignment of the shoulder with the aperture.

In a preferred embodiment, the pin member also includes an enlarged head portion severably or frangibly connected to the second portion and extending outwardly of the aperture portion for facilitating handling of the pin during insertion. The head portion is fractured after insertion of the pin member, to render the unit tamper-proof.

Other objects, features and advantages of the invention will become apparent upon reading the following detailed description with reference to the accompanying drawings, wherein like reference numerals refer to like parts.

DETAILED DESCRIPTION OF THE ILLUSTRATED EMBODIMENT

Figure 1:
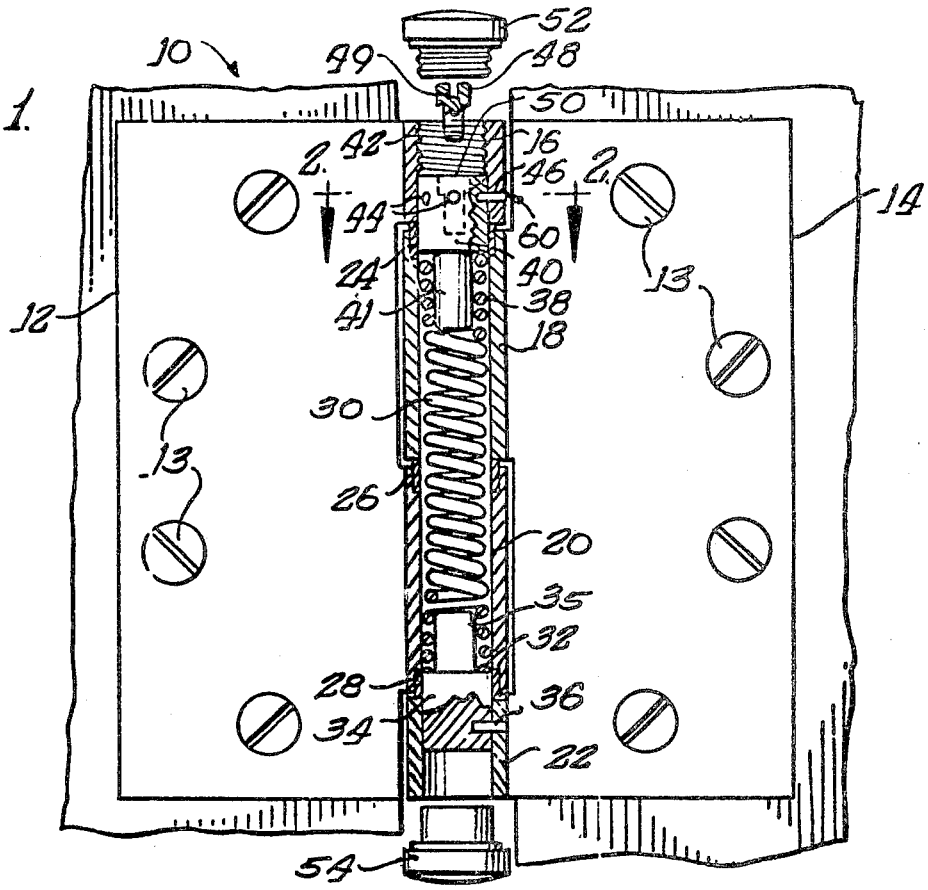
FIG. 1 is an elevational view of a hinge embodying the invention, partially exploded, and partially in section.

Attention is directed initially to FIG. 1, wherein a door hinge in accordance with the invention is illustrated and designated generally 10. The hinge 10 includes a pair of adjacent hinge leaves 12 and 14, within which a number of screw-accepting apertures 13 have been formed to permit the hinge 10 to be mounted to a door and door frame structure. In use, the leaves 12 and 14 rotate about the axis of the central barrel of the hinge 10, provided by a plurality of axially aligned hollow knuckles 16, 18, 20 and 22. These knuckles are arranged to interfit coaxially with the knuckles 16 and 20 being dependent from the leaf 12, and the knuckles 18 and 22 being dependent from the leaf 14. Thus, the knuckles are alternatively interfitted in axial array so as to interengage to provide the desired hinge action. In the illustrated embodiment, relatively small anti-friction bearing or sleeve members 24, 26 and 28 are positioned between adjacent knuckles to facilitate relative rotation therebetween and minimize inter-leaf friction during operation of the hinge.

The drawings illustrate a preferred form of the invention, wherein the respective hinge knuckles are maintained in position by an assembly comprised of a spring 30 and a pair of capstan members 34 and 40. This assembly in effect serves the general function of the standard hinge pintle, in that said assembly prevents lateral separation of the aligned knuckles. It is well known to employ spring hinges, wherein the spring is carried within a hollow tubular pintle element, with one end of the tube carried by a capstan connected to a first knuckle, and the other being rotatable with respect to the knuckles on the opposite hinge leaf. As will become apparent from the discussion to follow, the present invention can be employed with either type. Further, it should be noted that in the illustrated embodiment, the spring 30 also serves to exert a spring force on the respective hinge leafs, which can be employed to urge the door to either an open or closed position.

Spring 30 made of the coiled type, as illustrated, or also of a torsional design, in either case, said spring 30 is coaxially disposed within the knuckle barrel, and most particularly within the hinge knuckles 18 and 20. A first end 32 of the spring 30 is nonrotatably affixed to a suitable plug or capstan member 34 which in turn is fixed with respect to the knuckle 32. In the illustrated embodiment, the capstan 34 is affixed to the knuckle 22 by a pin member 36. It will be understood, however, that any suitable means may be utilized to assure permanent interengagement between the capstan 34 and knuckle 22. Also in the illustrated embodiment, the end 32 of the spring 30 is press fitted over an extension or finger 35 of the capstan member 34, it being understood that any suitable means may be provided for securing the end 32 of the spring to capstan 34. An opposite end 38 of the spring 30 is similarly press fitted over an extension 41 of a second capstan 40 which is rotatably inserted in the hinge knuckle 16.

The hinge knuckle 16 is provided with an internally threaded portion 42 axially outwardly of the capstan member 40, the inner diameter of the threaded portion 42 being generally smaller than the diameter of the capstan 40, thereby retaining the capstan 40 in captive relation within the knuckle 16. As will be recalled, the capstan 40 is rotatable with respect to the bearing member 24 and knuckle 18. Thus, during assembly the capstan 40 may be depressed and disposed entirely within the knuckle 18, by merely compressing the spring 30 somewhat. When the respective bores in knuckles 16 and 18 are aligned, the compressed spring will urge the capstan 40 into the knuckle 16 to attain the aforementioned rotatable captive relation within said knuckle.

In accordance with conventional practice, the capstan 40 is provided with a plurality of radially disposed inwardly extending sockets 44, in a circumferentially spaced array therearound. The sockets 44 are arranged such that they may be selectively brought into registry with a through aperture 46 formed in the knuckle 16, by rotation of the capstan 40. As an additional feature, the spacing between the innermost point on the threaded portion 42 of the aperture 46 is selected to be approximately equal to the spacing of the sockets 44 from the upper surface of capstan 40. Thus, not only does the threaded portion 42 maintain the capstan 40 in captive relation, but also serves upon torquing of the spring 30 to assure that the sockets 44 align with the aperture 46 preparatory to the insertion of a retaining pin 60, to be discussed more fully hereinafter. To facilitate this rotation, tool engaging means are provided on the capstan 40. In the illustrated embodiment, the tool engaging means is in the form of a threaded socket 50 designed to receive an adaptor screw 48, which screw 48 includes a hex type socket 49. As such, the screw 48 can be inserted, and a hex key engaged in socket 49 to rotate the capstan 40. Rotation of capstan 40 will tend to further coil the spring 30, building up increased torsional force therein. Once the desired spring force is attained a pin member, such as pin 60 to be discussed more fully hereinafter, is disposed through the aperture 46 into an aligned one of recesses 44, thus fixing the capstan in position and maintaining the torsional force built up in spring 30. It will be understood, that suitable alternative tool engaging means to the screw 48 and socket 50 may be provided for this purpose.

An additional advantageous feature of the arrangement as illustrated, is that the use of the adaptor screw 48 and socket 50 tend to preclude torquing of the spring 30 in the wrong direction. More specifically, if by accident the direction of the torquing force is exerted in a direction (i.e. counter-clockwise) opposite from that intended (i.e. clockwise), the adaptor screw 48 will back out of the socket 50, rather than produce improper torquing of the spring 30.

Suitable end caps 52, 54 are provided for enclosing the barrel defined by the knuckle 16 through 22, upon completion of an assembly of the hinge 10 and tensioning of the spring 30 as described above. Specifically, the end cap 52 may be provided with a suitable external thread for engaging the internal thread 42 of the knuckle 16, while the end cap 54 is preferably press fitted within the axially outer portion of the knuckle 22 upon initial assembly by the manufacturer. It will be appreciated that while "button tip" type end caps are illustrated herein, "flush tip" type end caps may be utilized. Further, it should be noted that while four knuckles 16, 18, 20 and 22, two associated with each hinge leaf 12, 14, are illustrated herein, more or less knuckles may be provided without departing from the principles of this invention.

Figure 2:
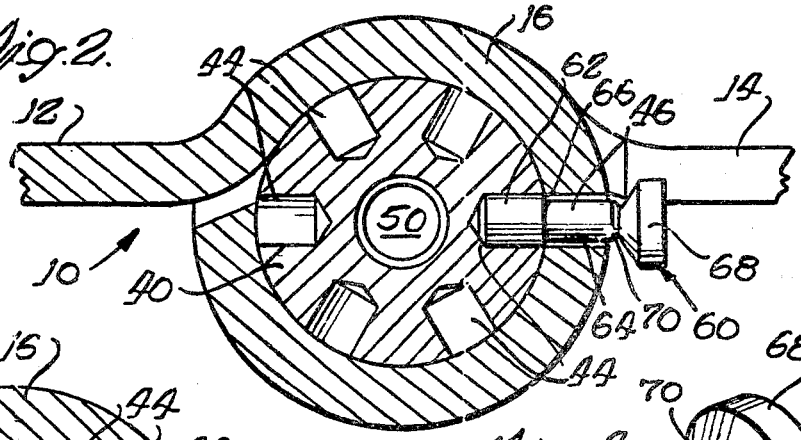
FIG. 2 is an enlarged partial sectional view, taken generally along the line 2—2 of FIG. 1, and illustrating the condition of the pin during insertion.
Figure 3:
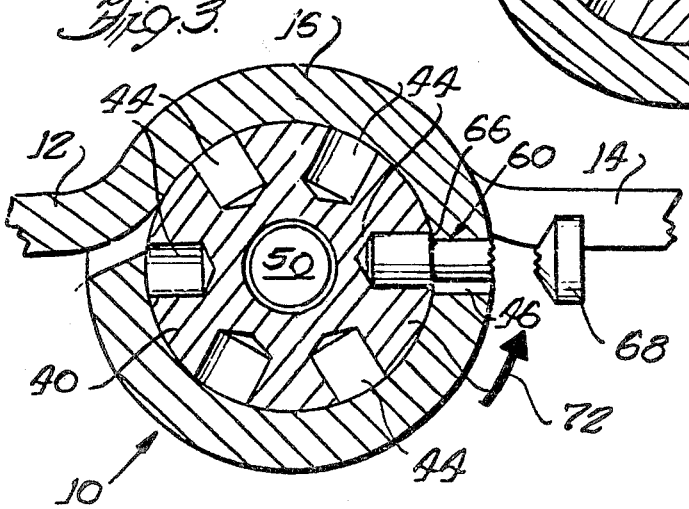
FIG. 3 is a partial sectional view, similar to FIG. 2, but illustrating the condition of the pin after it has been released, subsequent to insertion.
Figure 4:
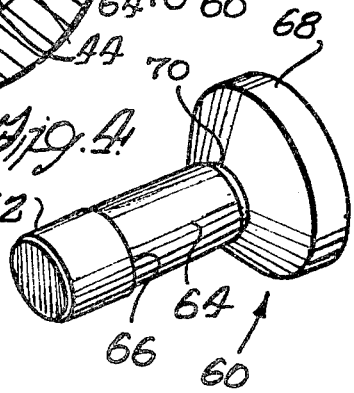
FIG. 4 is an enlarged perspective view of one form of retaining pin according to the present invention.

Referring now to FIGS. 2 through 4, a retaining pin member 60 in accordance with an important feature of the present invention, is illustrated in additional detail. As best seen in FIG. 4, the pin member 60 comprises first, generally cylindrical portions 62 and a second portion 64 of smaller diameter than the portion 62. The juncture of the respective portions 62 and 64 define an abrupt shoulder portion 66. Advantageously, the axial length of the first portion 62 is such that upon assembly the shoulder 66 will be disposed radially inward of the innermost end of aperture 46, for a purpose to be discussed more fully hereinafter. Further, an enlarged head portion 68 is provided adjacent to the second portion 64 to facilitate handling and insertion of the pin member 60 as described. In the illustrated embodiment, the head portion 68 is joined with the second or intermediate portion 64 by a severable or frangible portion 70, whereby the head portion 68 may be easily severed, following insertion of the pin member 60, as best seen in FIG. 3.

Attention will now be directed to the assembly operation utilizing the pin 60 as described above. In this regard, it is assured that suitable means have been employed to torque the spring 30 to a desired tension, aligning one of the sockets 44 with the knuckle aperture 46. The torsional force on the spring is maintained, and pin 60 is inserted with the shoulder 66 being disposed inwardly of the innermost end of aperture 46, as shown in FIG. 2. Accordingly, when the capstan 40 is released, the spring 30 will tend to cause a slight canting or radial movement of the capstan 40 relative to the knuckle 16, as indicated by the arrow 72. This canting or radial movement in the direction of the arrow 72, is such that the shoulder portion 66 of the pin 60 is urged out of alignment or registry with the aperture 46, as shown in FIG. 3. The torsioned spring force will tend to hold the pin member 60 in the position illustrated in FIG. 3, whereby the pin member 60 is precluded from moving outwardly of the socket 44 due to the engagement of shoulder 46 with the knuckle 16, this restraint being maintained against such forces as might occur during operation of the hinge, such as vibration, shock or the like, which forces tend to produce loosening of the conventional type pin members utilized in the prior art.

It will be recalled further that the pin 60 includes an enlarged head portion 68, joined to the second or intermediate portion 64 by a frangible section 70. The enlarged head portion 68 facilitates manipulation of the pin 60 during initial insertion. Should it be desired to render the hinge "tamper proof" after initial torsioning of spring 30, the frangible section 70 can be fractured, and the head 68 removed, as shown in FIG. 3.

It is believed clear that the present invention provides an improved design, which insures that the pin member will not become loose or dislodged during service, while this invention has been described and illustrated in conjunction with a preferred embodiment, it is not intended to limit the invention to the specific embodiment shown in the drawing. On the contrary, it is contemplated that those skilled in the art and possessed of this disclosure may advise various changes, modifications or alterations, as for example in the structure or relative portions of parts, without departing from the spirit and scope of the invention, as defined by the claims appended hereto.

The invention is claimed as follows:

1. A spring hinge comprising: first and second adjacent hinge leaves, each having at least one hinge knuckle, said hinge knuckles being axially aligned and defining a knuckle bore, a spring member mounted within said knuckle bore and having first and second ends, said first end engaged for rotation in unison with a first one of said knuckles, the second end engaged with a capstan member rotatably mounted within the other of said hinge knuckles, and means for selectively achieving and maintaining a spring force, said means including aperture means formed in said other hinge knuckle, socket means formed in said capstan member, and a retaining pin member selectively insertable through said aperture means into said socket means for maintaining said capstan member in a selected position, said pin member including a first forward portion sized to be received within said knuckle aperture means and said capstan socket means, and a second rearward portion of lesser diameter than said first portion and said knuckle aperture, with the juncture of said first and second portions defining an intermediate shoulder, said first portion having a length in relation to the depth of said capstan socket means such that upon insertion of said pin member, said intermediate shoulder is received within said capstan socket, and said second portion is disposed in said knuckle aperture, and said second portion being of lesser diameter than said aperture, said pin is free to move relative to said aperture, such that said intermediate shoulder is disposed for movement out of registry with said aperture means in said hinge knuckle in response to the force exerted on said capstan by said spring, said movement of said pin member bringing said intermediate shoulder in position to engage the inner end of said aperture means, thus precluding movement of said pin member out of said socket due to vibrational forces or the like.

2. A spring hinge according to claim 1 wherein there is included a second capstan member to which said first end of said spring is engaged, said second capstan member being disposed within the bore of said first knuckle and means fixing said capstan to said first knuckle.

3. A spring hinge according to claim 1, wherein said pin includes an enlarged head portion joined to said second portion by a frangible connection; such that said head portion can be fractured after initial tensioning of said spring to render said hinge tamper proof.

4. A spring hinge according to claim 1 wherein said capstan member is maintained in rotatable mounting with respect to said other knuckle by an internal thread formed in said knuckle, said thread having a minimum internal diameter, less than the outer diameter of said capstan.

5. A spring hinge according to claim 1 including means for selectively rotating said capstan to tension said spring prior to insertion of said pin member.

6. A spring hinge according to claim 5, wherein said means for selectively rotating said capstan, includes an internal threaded bore in said capstan, an adaptor screw disposable in said bore and including tool engaging means, said adaptor screw being threaded such that if it is attempted to rotate said capstan in a direction opposite that required for torquing said spring member, said adaptor screw will be backed out of said threaded bore.

7. A spring hinge comprising: first and second adjacent hinge leaves, each having at least one hinge knuckle, said hinge knuckles being axially aligned and defining a knuckle bore, a spring member mounted within said knuckle bore and having first and second ends, said first end engaged for rotation in unison with a first one of said knuckle, the second end engaged with a capstan member rotatably mounted within the other of said hinge knuckles, and means for selectively achieving and maintaining a spring force, said means including aperture means formed in said other hinge knuckle, socket means formed in said capstan member, and a retaining pin member selectively insertable through said aperture means into said socket means for maintaining said capstan member in a selected position, said other hinge knuckle including an internally threaded portion formed therein, and an externally threaded end cap member adapted to be engaged with said internally threaded portion, the threads defining said internally threaded portion having an effective inner diameter less than the diameter of said capstan member, said capstan member under the action of said spring member having abutment surface means thereon urged against said internal thread, and the spacing of said internal thread from said aperture means formed in said other knuckle being approximately equal to the spacing of said socket means from the abutment surface means on said capstan, such that said internal thread serves to maintain said capstan in captive relation within said knuckle and also axially align said socket means with said aperture means.

8. A spring hinge according to claim 7 wherein said pin member including first and second portions defining an intermediate shoulder portion, said shoulder portion being receivable within said capstan socket and disposed for movement out of registry with said aperture means in said hinge knuckle following said insertion of said pin member in response to the force exerted on said capstan by said spring, thus precluding movement of said pin member in a direction opposite the direction of said insertion due to vibrational forces or the like.

9. In a spring hinge comprising: first and second adjacent hinge leaves, each having at least one hinge knuckle, said hinge knuckles being axially aligned and defining a knuckle bore, a spring member mounted within said knuckle bore and having first and second ends, said first end engaged for rotation in unison with a first one of said knuckles, the second end engaged with a capstan member or the like rotatably mounted within the other of said hinge knuckles, and means for selectively achieving and maintaining a spring force, and means for insuring the torquing of said spring member in a single, desired direction, said last mentioned means, including a threaded socket formed in an end surface of said capstan, an adaptor screw engaged in said socket and including tool engaging means, adapted for the reception of a tool used to torque said spring, and the mating threads on said socket and said screw being oriented such that an attempt to torque said spring in the wrong direction will back said adaptor screw out of said socket, thereby permitting said spring to be torqued in but a single direction and insuring that said spring will be properly torqued.

10. A spring hinge according to claim 9 wherein said means for achieving and maintaining a spring force includes aperture means formed in said other hinge knuckle, socket means formed in said capstan member, and a retaining pin member selectively insertable through said aperture means into said socket means for maintaining said capstan member in a selected position.

11. A spring hinge according to claim 9 wherein said pin member includes first and second portions defining an intermediate shoulder portion, said shoulder portion being receivable within said capstan socket and disposed for movement out of registry with said aperture means in said hinge knuckle following said insertion of said pin member in response to the force exerted on said capstan by said spring, thus precluding movement of said pin member in a direction opposite the direction of said insertion due to vibrational forces or the like.

* * * * *